US008607484B2

(12) United States Patent
Rosenzweig et al.

(10) Patent No.: US 8,607,484 B2
(45) Date of Patent: Dec. 17, 2013

(54) SYSTEM, COMPONENTS AND METHOD FOR TREATING A FABRIC

(75) Inventors: Mark Rosenzweig, Chestnut Hill, MA (US); Dan Bilger, Amherst, NH (US); Dann Provolo, Barrington, RI (US); Peggy Lam, Randolph, MA (US); Eric Wall, Auburn, AL (US)

(73) Assignee: Euro-Pro Operating LLC, Newton, MA (US)

( * ) Notice: Subject to any disclaimer, the term of this patent is extended or adjusted under 35 U.S.C. 154(b) by 415 days.

(21) Appl. No.: 12/860,554

(22) Filed: Aug. 20, 2010

(65) Prior Publication Data

US 2011/0030249 A1 Feb. 10, 2011

(51) Int. Cl.
*D06F 83/00* (2006.01)
*D06C 15/00* (2006.01)

(52) U.S. Cl.
USPC ..... 38/141; 38/144; 223/61

(58) Field of Classification Search
USPC ..... 38/103–141; 223/68–70, 52–66
See application file for complete search history.

(56) References Cited

U.S. PATENT DOCUMENTS 2,437,084 A * 3/1948 Esecson ..... 38/12
3,217,434 A * 11/1965 Konopa ..... 38/108
3,430,368 A * 3/1969 Wright, Jr ..... 38/21
3,568,900 A * 3/1971 Paris ..... 223/70
4,894,935 A * 1/1990 Kretz ..... 38/137
6,153,862 A * 11/2000 Job ..... 219/521
6,514,924 B1 * 2/2003 Van Hauwermeiren et al. ..... 510/284
6,910,291 B2 * 6/2005 Schwass ..... 38/14
6,922,911 B2 * 8/2005 Lam ..... 34/239
2003/0019087 A1 1/2003 Pasin et al.
2007/0295769 A1 12/2007 Burroughs
2008/0217364 A1 9/2008 Fong
2009/0173758 A1 7/2009 Hahn

OTHER PUBLICATIONS

[No Author Listed] Mounting Your Jiffy® Steamer Steamboard. Jiffy Steamer Company, LLC. Printed Jul. 23, 2010. Available at http://www.jiffysteamer.com/manager/file.asp?tableName=tblProducts&idField=productID&namePrefix=pdf&idValue=412. Last accessed Feb. 8, 2011. 1 page.

[No Author Listed] Accessories for Jiffy® Steamers. Item #0892A for Steamboard. Jiffy® Steamer Steamboard. Printed Jul. 23, 2010. Available at http://www.jiffysteamer.com/accessories/viewdetails.asp?productId=412. Last accessed Feb. 8, 2011. 2 pages.

* cited by examiner

*Primary Examiner* — Ismael Izaguirre
(74) *Attorney, Agent, or Firm* — Wolf, Greenfield & Sacks, P.C.

(57) ABSTRACT

A pad system for facilitating treatment of a fabric includes a pad which is placed adjacent to a support surface, and fabric grips which secure the fabric against the pad. The fabric grips may be attachable to the pad. The fabric grips may be used to arrange the fabric on the pad and provide tension to the fabric to facilitate fabric treatments such as steaming, heating and/or pressing.

33 Claims, 8 Drawing Sheets

SYSTEM, COMPONENTS AND METHOD FOR TREATING A FABRIC

BACKGROUND

Garment steamers are often used to smooth wrinkles in clothing or other fabrics, and also as a way of freshening clothes between cleanings. Typically, a garment steamer releases steam toward a target fabric, and the steam relaxes the fibers in the fabric. In some steamers, the steam is emitted from a nozzle, and in other steamers, the steam is emitted from holes in a flat metal plate. Irons are often used to smooth wrinkles in fabrics by heating the fabric and flattening the fibers with pressure applied by an iron plate.

SUMMARY

Embodiments of the invention provided herein are directed to appliances, components, methods and systems in which a pad system is used for facilitating the treatment of a fabric.

According to one embodiment, a method of treating a fabric includes acts of positioning a pad adjacent to a support surface, positioning a fabric adjacent to the pad such that at least a portion of the pad is between the fabric and the support surface, and gripping the fabric with a fabric grip. The method further includes securing the fabric grip such that tension is applied to the fabric, and treating the fabric.

According to another embodiment, a pad for arranging a garment adjacent to a support surface includes an exposed cloth layer, a rigid layer, a flexible backing layer, and a garment hanger holder.

According to a further embodiment, a kit of parts includes a foldable pad capable of being positioned adjacent to a support surface and a plurality of fabric grips. The fabrics grips are configured to hold a fabric relative to the support surface such that at least a portion of the foldable pad is capable of being positioned between the fabric and the support surface.

Further features and advantages of the embodiments of the present invention, as well as the structure of the various embodiments of the present invention are described in detail below with reference to the accompanying drawings.

BRIEF DESCRIPTION OF DRAWINGS

The accompanying drawings are not intended to be drawn to scale. For purposes of clarity, not every component may be labeled in every drawing. In the drawings.

DETAILED DESCRIPTION OF INVENTION

Figure 1:
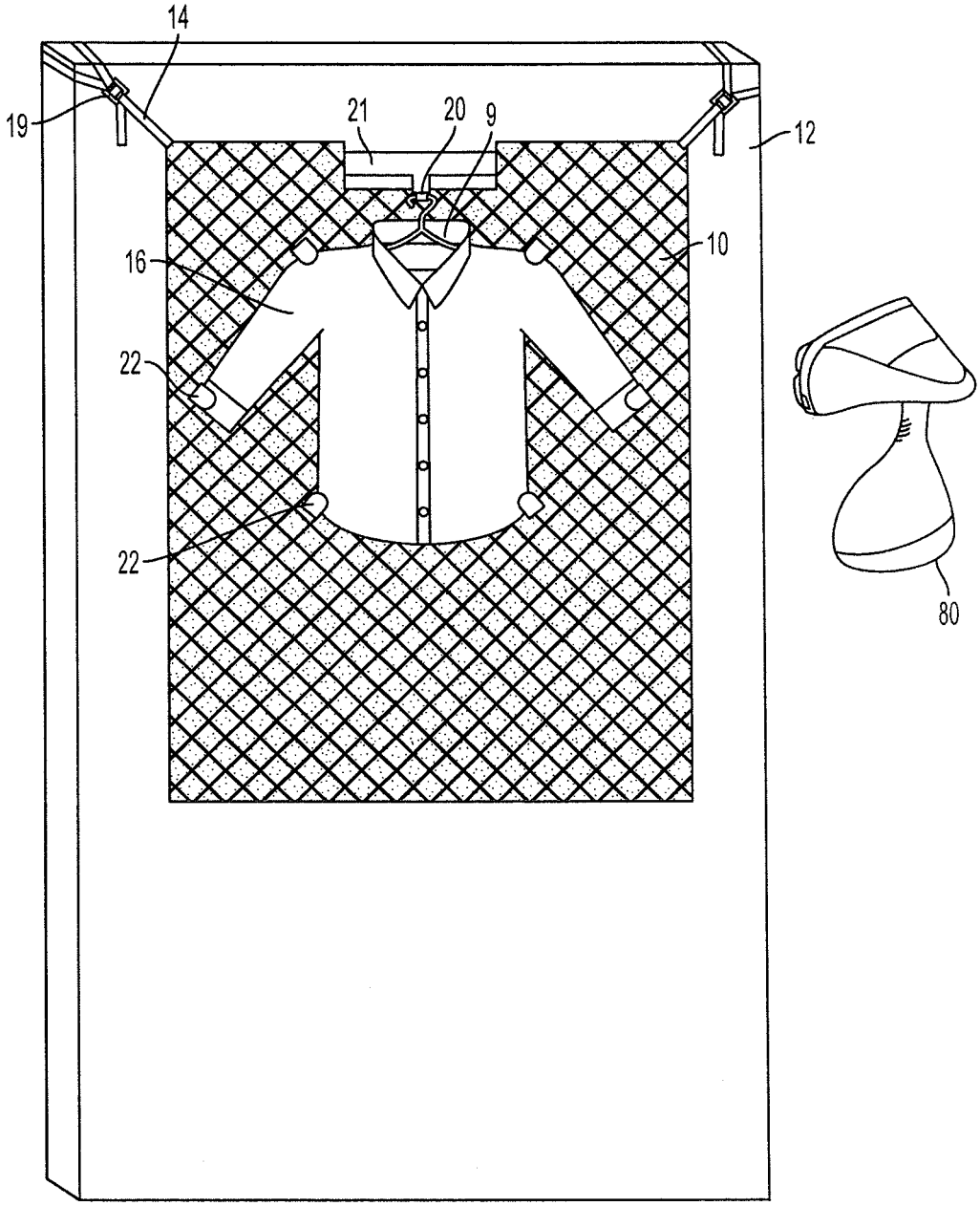
FIG. 1 shows a perspective view of a pad system for treating a fabric.

Various aspects of the invention are described below and shown in the drawings. These aspects of the invention may be used alone or in any suitable combination with each other. Aspects of the invention are not limited in any way by the illustrative embodiments shown and described herein. In addition, it should be understood that aspects of the invention may be used alone or in any suitable combination with other aspects of the invention.

Certain embodiments of the invention provided herein are directed to a pad system which may be used with fabric care appliances to freshen and press various fabrics with a handheld steam and/or heat applicator. According to one aspect of the disclosure, a fabric may be positioned and tensioned on a pad to facilitate the treatment of the fabric, for example the application of steam and/or heat to the fabric.

Known garment steamer systems that apply only steam to fabrics can be useful in many situations. Such steamers often include a handheld unit which is configured to deliver steam to a fabric via a steam nozzle or other steam outlet. These systems may include swivel hangers and telescoping poles with mechanical clips for positioning fabrics in an opened-out configuration to facilitate steam application. However, for smoothing wrinkles and giving fabrics a crisp look, application of steam alone may provide only temporary wrinkle reduction. In some cases, once the fabric dries, some of the wrinkles may reappear. Typical garment steamer systems do not provide backing support if the user wishes to apply pressure to the fabric, nor do they allow a garment to be tensioned or stretched other than by gravitational forces.

Applying tension to a fabric and/or providing a backing against which the fabric is pressed during steam and/or heat application may facilitate removal of wrinkles. In certain embodiments of the system disclosed herein, a fabric is arranged on a support surface, such as a vertical or slanted surface prior to fabric treatment. The fabric may be held in an expanded configuration with fabric-gripping elements (e.g., fabric clips) by positioning the fabric-gripping elements such that they apply tension to the fabric. That is, the fabric may be held in a configuration other than how the fabric would naturally hang when supported only from its top.

Tension beyond that sufficient to merely hold the fabric in an expanded state may be applied with the clips to stretch and/or flatten the fabric. In such an arrangement, steam and/or heat relaxes the fibers in the fabric and the tensioning and/or pressing of the fabric may stretch the fibers into a flattened and/or aligned state. The vertical or slanted support surface allows the fabric to be pressed with greater force than could be applied to a hanging fabric that has no backing support. In alternative embodiments, a pad is arranged on a horizontal support surface, and fabric grips are used to hold the fabric relative to the horizontal support surface with at least a portion of the pad between the fabric and the horizontal support surface.

A pad system for treating fabrics is shown in FIG. 1. A pad 10 is positioned adjacent to a vertical support surface 12 such as a door, wall, or other suitable surface. Pad 10 may be flexible or rigid. For instance, a flexible pad could be used for travel applications. In some embodiments, pad 10 is made of fabric and is foldable for packing and storing. An insert formed with material that is more rigid than the fabric of pad 10 may be included in some embodiments to provide a flat surface when the support surface is uneven, and the insert may be removable and/or rollable for packing and storing.

Pad 10 may be positioned adjacent to vertical support surface 12 with straps 14 which extend from pad 10, although other positioning elements may be used such as hooks, rods, hangers, nails, screws, adhesives, or other suitable fasteners. Straps 14 may be permanently attached to pad 10 in some embodiments. Straps 14 may include adjustable buckles 19 in some embodiments to adjust strap length for positioning of pad 10 adjacent to vertical surface 12 at a desired height.

In some embodiments, fabric 16 is a garment which may be positioned adjacent to pad 10 using a garment hanger 9 that engages a hanger holder 20. Hanger holder 20 may include a rod 21, an eye screw, a reinforced cut-out in pad 10, or other suitable hanger holder.

One or more fabric grips 22 may be used to arrange and/or tension fabric 16 prior to applying steam and/or heat. Fabric grips 22 are adapted to grip fabric 16 without damaging the material. In addition to gripping fabric 16, fabric grips 22 also may be constructed and arranged to be attached directly to pad 10. The combination of gripping the fabric 16 and attaching the fabric grip 22 directly to pad 10 allows a user to arrange/tension fabric 16 while the fabric is in a substantially vertical orientation. If desired, the fabric grips 22 may be attached to pad 10 at multiple selected locations to arrange and tension fabric 16 in multiple locations and directions. The fabric grips 22 also may be used to hang fabric 16 adjacent to pad 10, for example, instead of using a hanger such as garment hanger 9. Fabric grips 22 may selectively attachable to pad 10 by a user, or in some embodiments, one or more fabric grips may be pre-attached to pad 10.

Once suitably arranged and tensioned on pad 10, a fabric care appliance 80 may be used to apply steam and/or heat to fabric 16. Dependent upon the type of fabric care appliance employed, this process may include pressing fabric 16 against pad 10 to enhance wrinkle removal.

Figure 2A:
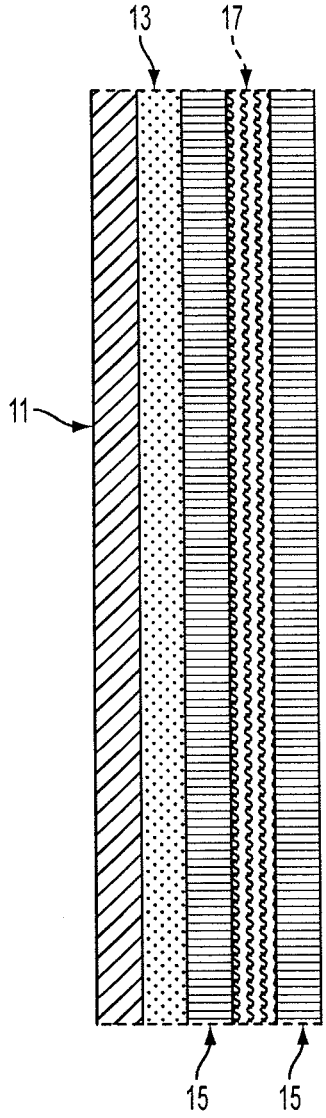
FIG. 2*a* shows a cross-sectional view of the internal layer arrangement of a pad and a rigid insert according to one embodiment of the invention.

As shown in FIG. 2*a*, in some embodiments, pad 10 may include a layer of quilted terry cloth 11 and a layer of mesh padding 13, and may include one or more layers of water-resistant nylon 15 as a backing material. Pad 10 may incorporate other moisture and/or heat resistant materials to provide additional protection to the support surface.

One or more rigid inserts 17 may be added to pad 10 to provide a smooth support surface when pad 10 is placed over an uneven surface, such as a panel door, for example. In some embodiments, rigid inserts 17 may provide additional heat and/or moisture protection for the support surface. Rigid inserts 17 may have a square shape, a rectangular shape, or any other suitable shape. The inserts may be any suitable size, for example 11 inches by 11 inches with a thickness of approximately 0.8 mm. The inserts may be constructed of polypropylene, polycarbonate, acetate, or any suitable combination thereof. Of course, other suitable materials or material combinations may used to form the rigid inserts as long as the material can withstand the heat, moisture and/or other factors that may be associated with typical use. For example, a 0.8 mm thickness of polypropylene is water-resistant and heat-resistant in the embodiment shown in FIG. 2*a* because during typical use with steam and heat application, the rigid insert maintains its structural integrity.

In certain embodiments, such as the embodiment shown in FIG. 2*a*, rigid insert 17 is held within pad 10 between two opposing layers of nylon 15. The inserts may be positioned between other layers of a pad, or may be positioned on a rear surface of a pad such that the inserts are not positioned between layers. Rigid inserts 17 (or other components of pad 10) may include magnetic material so that fabric grips having magnets can be attached to pad 10.

Figure 2B:
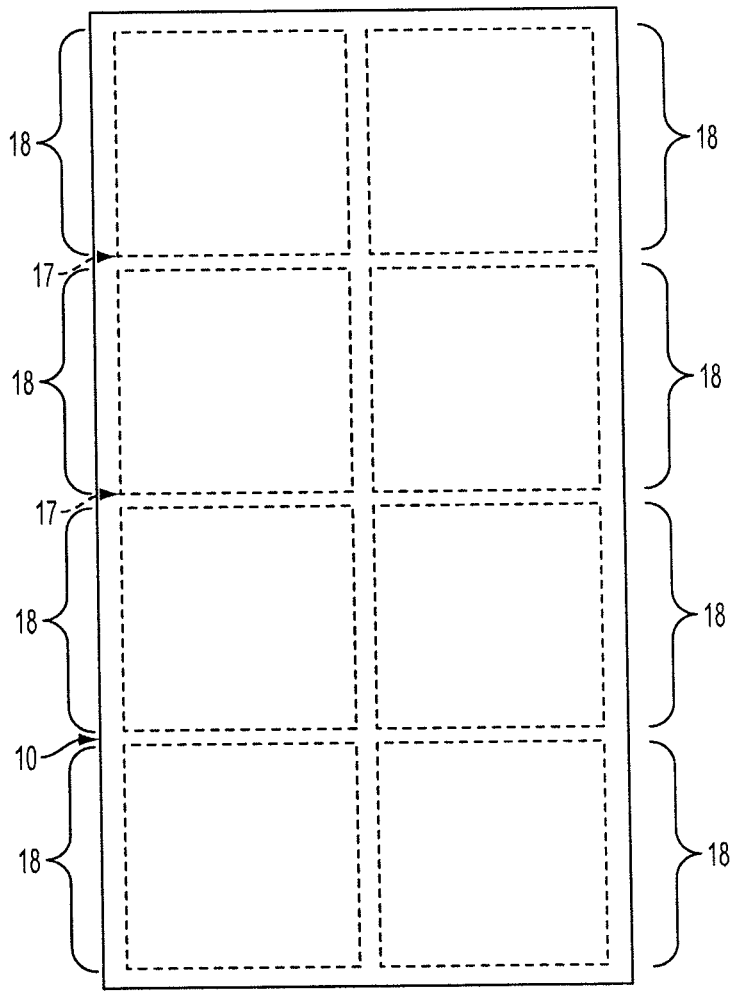
FIG. 2*b* shows the arrangement of the rigid inserts within the pad.

FIG. 2*b* shows the arrangement of a plurality of rigid inserts 17, depicted by dashed lines, being held in pad 10. In the embodiment shown in FIG. 2*b*, eight rigid inserts 17 are arranged in a rectangular two by four pattern across substantially the entire area of pad 10. This particular arrangement of inserts 17 (among others) allows pad 10 to be folded into a portable size with the rigid inserts remaining in the pad. In other embodiments, rigid inserts 17 may be arranged in a different pattern and/or may be arranged only across a portion of the area of pad 10.

Removable rigid inserts may be provided so that the inserts can be removed for laundering of the pad. In some embodiments, rigid inserts 17 may be inserted into openings 18 for retaining sleeves, pockets or other receptacles (not shown) arranged on pad 10. Openings 18 may include hook and loop fasteners or other closure elements to aid in retaining the inserts in the receptacles. Of course, in some embodiments, rigid inserts 17 may be permanently held within pad 10.

Figure 3:
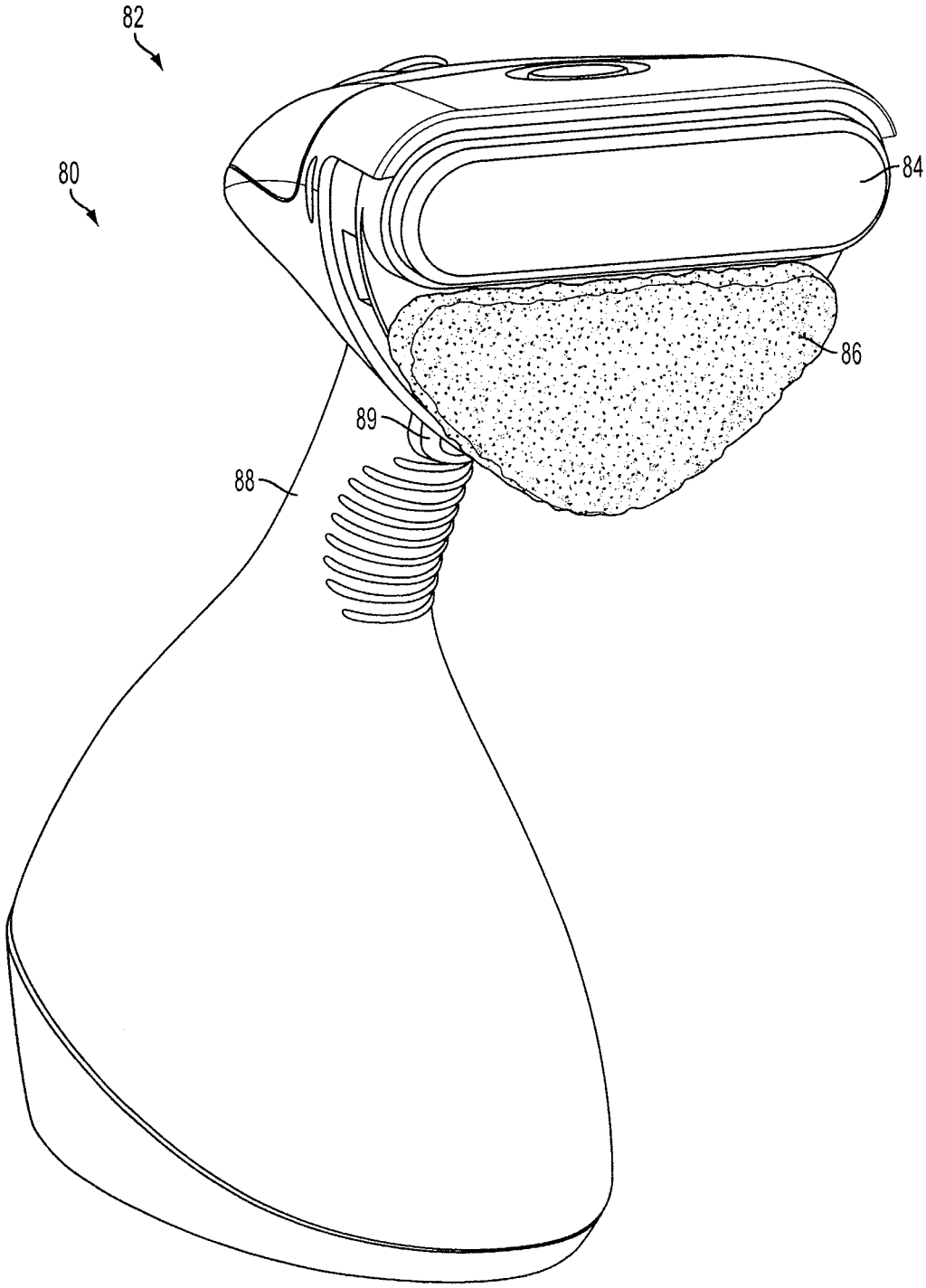
FIG. 3 shows a perspective view of one type of fabric care appliance for use with the pad system.

One embodiment of a fabric care appliance 80 which may be used with the pad system disclosed herein is shown in FIG. 3. Fabric care appliance 80 has an operating head 82 including a heating bar 84 and a fabric covered steam outlet 86. A hand grip area 88 is positioned below operating head 82 with convenient access to a trigger 89 which a user actuates to emit steam from the steam outlet.

By positioning heating bar 84 (or other heating surface) on the same appliance body as a steam outlet, as a user moves the handheld unit across the surface of a fabric, steam is applied to the fabric, followed by a pressing action of heating bar 84 against the fabric 16. This dual action can be achieved with a single pass of fabric care appliance 80 when the appliance body is moved in a direction where the steam outlet leads heating bar 84. Of course in some embodiments, a user may apply steam to an area of a fabric, and then in a separate motion, return to the same fabric area and apply heat with the heating bar.

It should be understood that the fabric care appliance 80 described herein is only one of many fabric care appliances that could be used with the current system. It is possible that an appliance might apply only steam or only heat. Further, heating bar 84 and fabric covered steam outlet 86 may be reversed in position. Fabric care appliance 80 may employ more than one heating surface and/or more than one steam outlet. In some embodiments, a fabric care appliance may be configured to treat a fabric in other suitable manners, such as by applying a fluid, a spray, or a gas, whether heated, cooled or at ambient temperature.

Figure 4:
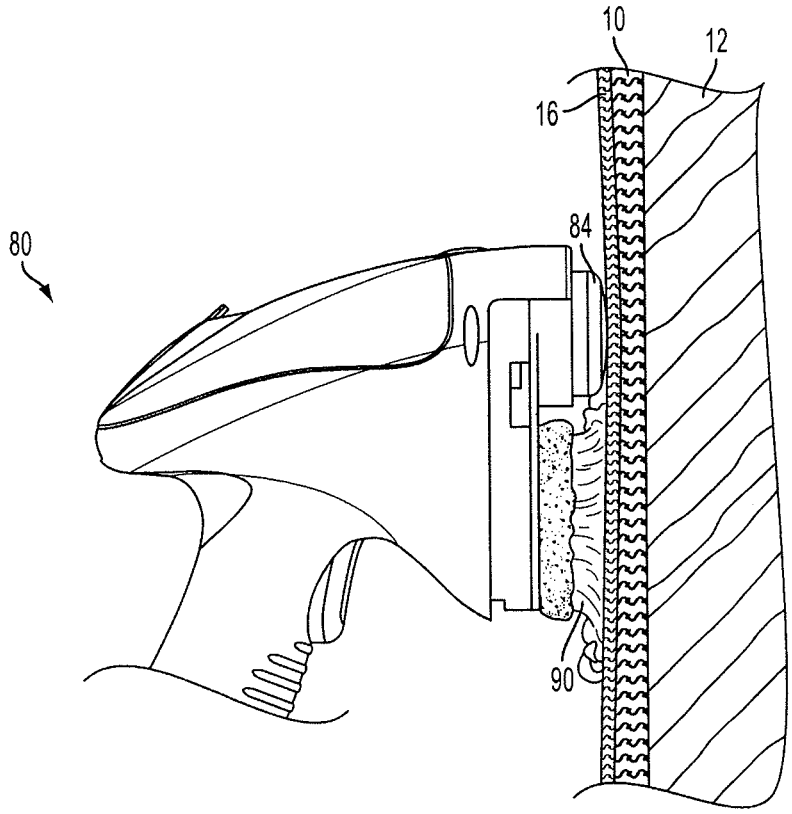
FIG. 4 shows a side view of a fabric care appliance pressing and applying steam to a fabric.

As shown in FIG. 4, a fabric care appliance 80 may be used to apply steam 90 to a target fabric 16 while simultaneously pressing fabric 16 with a heating surface, such as heating bar 84. As discussed further above, to help the user apply pressure to fabric 16 with heating bar 84, fabric 16 is arranged on pad 10 which is interposed between fabric 16 and a vertical surface 12 such as a door. In addition to providing a backing for steaming and pressing, pad 10 protects fabric 16 and the vertical surface 12.

Figure 5:
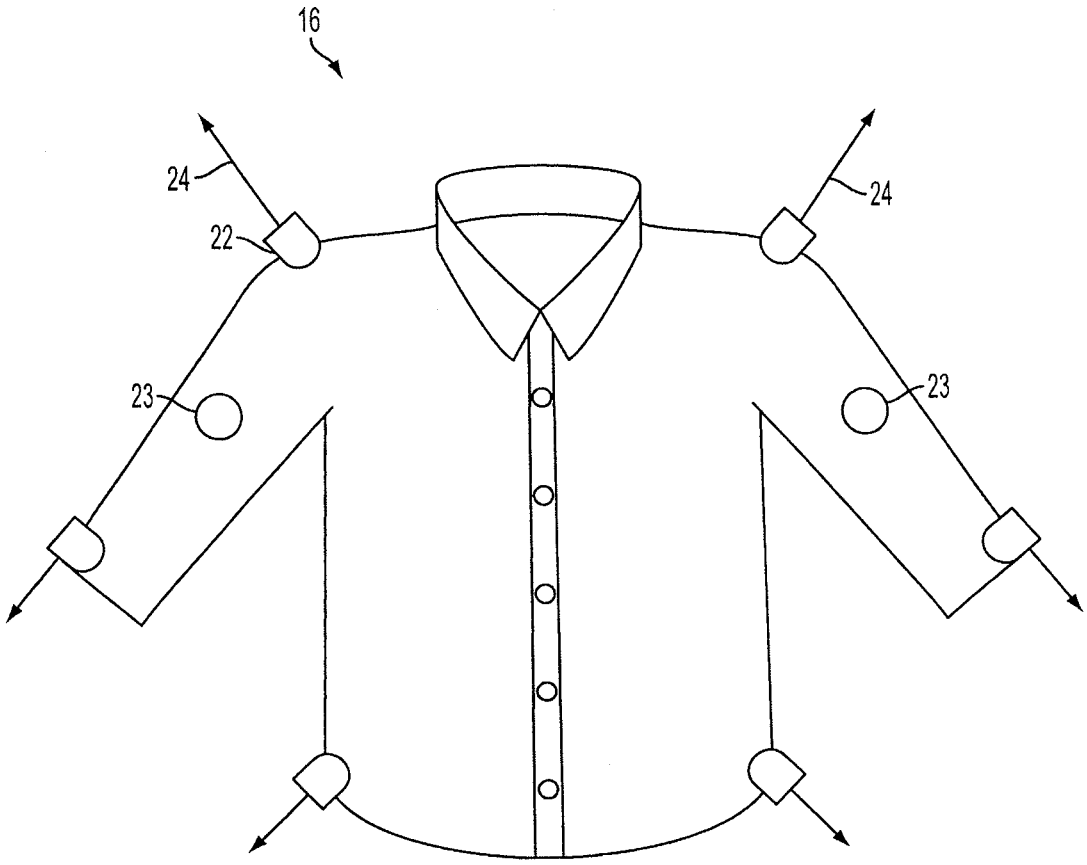
FIG. 5 shows fabric grips applying tension to a fabric garment.

FIG. 5 illustrates a fabric 16, in this case a shirt, arranged and tensioned using fabric grips 22. Fabric grips 22 may grip fabric 16 using a clip as shown by fabric grip 22 positioned around the edge of fabric 16. Friction from pressing fabric 16 against pad 10, for example with a magnet 23, can hold and/or tension the fabric. Other suitable elements configured to grip fabric 16 may be used. Arrows 24 denote directions of tension applied to fabric 16 by fabric grips 22 as a result of the particular arrangement shown in FIG. 5.

Figure 6:
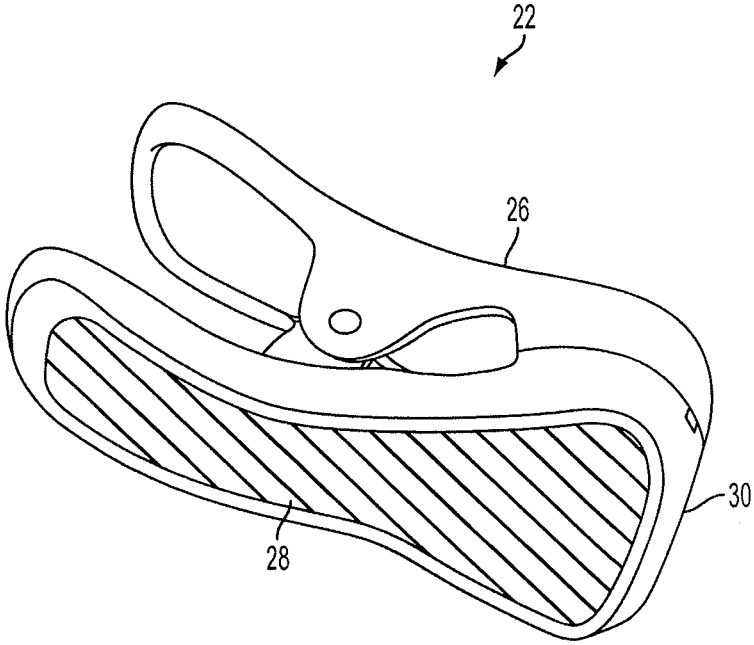
FIG. 6 shows a perspective view of one embodiment of a fabric grip having a surface adapted to attach to the pad.

One embodiment of a fabric grip 22 is shown in FIG. 6. A clip 26 includes jaws 30 which are biased closed with a spring or other resilient arrangement. Jaws 30 are adapted to grip fabrics without damaging the material. Clip 26 additionally has a pad-engagement surface 28 adapted to attach to a corresponding surface of pad 10. FIG. 5 shows one embodiment wherein the pad-engagement surface 28 comprises a hook and loop fastener material (e.g., Velcro®) on a majority of the surface. The term "hook and loop fastener material" is intended to include either of only "hook material" and only "loop material", or both of "hook material" and "loop material". It should be recognized that in some embodiments, only a portion of one side of fabric grip 22 includes pad-engagement material, while in other embodiments the entirety of one side of fabric grip 22 is adapted to be a pad-engagement surface. In other embodiments, attachment surface 28 of fabric grip 22 may comprise any suitable elements configured to attach fabric grip 22 to pad 10, including but not limited to, a magnet or a mechanical fastener such as a clip or a peg and hole arrangement.

In some embodiments, fabric grips 22 have pad-engagement surfaces on both sides or more than two sides. Such an arrangement may facilitate rapid treatment of at least two surfaces of a garment. For example, a method of treating two surfaces may include acts of treating a first surface of the garment which is held by at least one fabric grip 22, disengaging the fabric grip 22 from the pad 10 without disengaging the garment from the fabric grip 22, flipping or rotating the clothing to present a second, untreated surface, re-engaging the fabric grip 22 to the pad 10, and treating the second garment surface. In some embodiments, having dual pad-engagement surfaces on the fabric grip 22 may allow a garment to be folded or bent with respect to the pad 10 to facilitate quick treatments of various areas of the garment.

Figure 7:
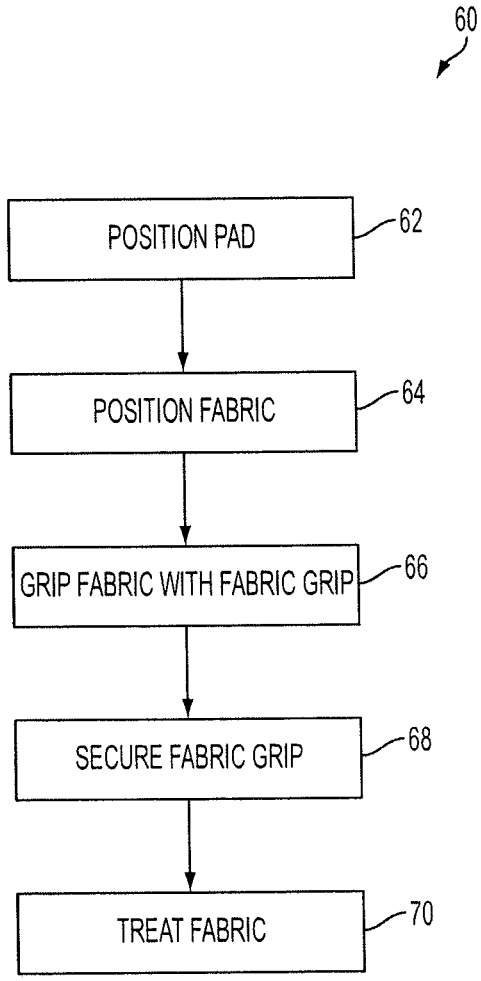
FIG. 7 shows a flow chart of a method of treating a fabric.

FIG. 7 presents a flow chart 60 of a method of using a pad system to treat a fabric. The method includes an act 62 of positioning a pad adjacent to a support surface. An act 64 includes positioning a fabric adjacent to the pad such that at least a portion of the pad is positioned between the fabric and the support surface. The fabric is gripped with a fabric grip in an act 66. In an act 68, the fabric grip is secured such that tension is applied to the fabric. To secure the fabric grip, the fabric grip may be attached to the pad, or may be attached to the door, or may be attached through the pad to the door. In some embodiments, as discussed further above, the attachment of the fabric grip to the pad may be achieved using a pad-engagement surface on the fabric grip. This pad-engagement surface may include a hook and loop fastener material. An act 70 includes treating the fabric, such as by applying at least one of steam and heat to the fabric, for example. It should be understood that this method is not necessarily limited by the order in which the acts are recited.

A kit of parts can be supplied to facilitate methods disclosed herein of using a pad system for treating a fabric. The kit of parts includes, but is not limited to, a pad and one or more fabric grips. The pad is positionable adjacent to a support surface such as a door, wall, or other suitable surface, and the pad may be foldable. The fabric grips are configured to hold a fabric relative to the support surface such that at least a portion of the pad is positioned between the fabric and the support surface. The pad also may have an engagement surface that is adapted to attach to the fabric grips. Each fabric grip may include an engagement surface that is adapted to attach to the pad. The kit of parts also may include attachment elements, such as straps, which are configured and adapted to attach the pad to the support surface. The attachment elements may be selectively attachable to the pad or permanently attached to the pad. The various parts of the unit of parts may be packaged in any convenient manner and may be sold individually in separate packages or together in a single package. Instructions for the use of the component parts of this kit may be available through a set of printed instructions packaged with the kit, on a digital readable media packaged with the kit, on the internet, or may be distributed by any other readable means.

For purposes herein, the terms "engage", "engaged", "engagement", "attach", "attached" and "attachment" refer to direct connections and attachments, indirect connections and attachments, and operative connections and attachments. For purposes herein, the term "adjacent" includes being in contact with an element or in close proximity to an element. Two elements may be adjacent to one another even if a third element is located between the two elements. It should be understood that acts listed in the claims do not necessarily have to be performed in the order recited unless an order of acts is specifically recited.

Having thus described several aspects of embodiments of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A method of treating a fabric comprising acts of:

(a) positioning a pad adjacent to a support surface;

(b) positioning a fabric adjacent to the pad such that at least a portion of the pad is between the fabric and the support surface;

(c) gripping the fabric with a fabric grip;

(d) securing the fabric grip such that tension is applied to the fabric, wherein securing the fabric grip such that tension is applied to the fabric comprises attaching the fabric grip to the pad, wherein attaching the fabric grip to the pad comprises attaching the fabric grip to the pad with a hook and loop fastening material which is included on the fabric grip; and (e) treating the fabric.

2. The method of claim 1, wherein attaching the fabric grip to the pad in act (d) comprises pressing a pad-engagement surface of the fabric grip against the pad.

3. The method of claim 1, wherein (c) comprises gripping the fabric with a plurality of fabric grips, and (d) comprises attaching the plurality of fabric grips to the pad.

4. The method of claim 1, wherein (a) comprises positioning the pad adjacent to a vertical support surface.

5. The method of claim 1, wherein the pad comprises a hanger holder and (b) comprises engaging a hanger with the hanger holder.

6. The method of claim 1, wherein (a) comprises positioning a pad which includes a flexible cloth layer.

7. The method of claim 1, wherein (a) comprises positioning a pad which includes a terry cloth layer and a water-resistant backing material.

8. The method of claim 1, wherein (a) comprises positioning a pad which includes a cloth layer and a layer of rigid support material.

9. The method of claim 1, wherein (e) comprises pressing the fabric.

10. A method of treating a fabric comprising acts of:

(a) positioning a pad adjacent to a support surface wherein positioning a pad adjacent to a support surface comprises positioning a pad which includes a cloth layer and a layer of rigid support material, wherein the layer of rigid support material comprises a plurality of rigid support material sections positioned such that the pad is foldable;

(b) positioning a fabric adjacent to the pad such that at least a portion of the pad is between the fabric and the support surface;

(c) gripping the fabric with a fabric grip;

(d) securing the fabric grip such that tension is applied to the fabric, and (e) treating the fabric.

11. The method of claim 10, wherein (d) comprises attaching the fabric grip to the pad with a hook and loop fastening material which is included on the fabric grip.

12. The method of claim 10, wherein (a) comprises positioning a pad which includes a terry cloth layer and a water-resistant backing material.

13. A pad for arranging a garment adjacent to a support surface, the pad comprising:

(a) an exposed cloth layer;

(b) a rigid layer, wherein the rigid layer comprises a plurality of rigid sections positioned such that the pad is foldable and the pad comprises a plurality of receptacles, each configured to hold at least one rigid section;

(c) a flexible backing layer; and (d) a garment hanger holder.

14. The pad of claim 13, further comprising at least two attachment loops, each loop being configured to engage a corner of a door to hold the pad adjacent to the door.

15. A pad for arranging a garment adjacent to a support surface, the pad comprising:

(a) an exposed cloth layer:

(b) a rigid layer;

(c) a flexible backing layer;

(d) a garment hanger holder; and (e) at least two attachment loops, each loop being configured to engage a corner of a door to hold the pad adjacent to the door.

16. The pad of claim 15, wherein the rigid layer comprises a plurality of rigid sections positioned such that the pad is foldable.

17. The pad of claim 16, wherein the pad comprises a plurality of receptacles, each configured to hold at least one rigid section.

18. A pad for arranging a garment adjacent to a support surface, the pad comprising:

(a) an exposed cloth layer;

(b) a rigid layer;

(c) flexible backing layer;

(d) a garment hanger holder; and (e) a mesh layer between the exposed cloth layer and the flexible backing layer.

19. A kit of parts comprising:

(a) a foldable pad that is positionable adjacent to a support surface; and (b) a plurality of fabric grips, wherein the fabric grips are attachable to the foldable pad, wherein each fabric grip includes a clip and a pad-engagement surface configured to engage with the foldable pad, wherein the pad-engagement surface comprises a hook and loop fastener material, and the foldable pad comprises an exposed material which is engageable with the hook and loop fastener material of the pad-engagement surface, the fabric grips being configured to hold a fabric relative to the support surface such that at least a portion of the foldable pad is positioned between the fabric and the support surface.

20. The kit of parts of claim 19, wherein each fabric grip includes a pad-engagement surface on at least two sides of the fabric grip.

21. The kit of parts of claim 19, further comprising a fabric care appliance that has a heatable pressing surface.

22. The kit of parts of claim 19, further comprising attachment elements constructed and arranged to attach the foldable pad to the surface.

23. The kit of parts of claim 22, wherein the attachment elements are constructed and arranged to attach the foldable pad to a vertical support surface.

24. A kit of parts comprising:

(a) a foldable pad that is positionable adjacent to a support surface;

(b) a plurality of fabric grips, the fabric grips being configured to hold a fabric relative to the support surface such that at least a portion of the foldable pad is positioned between the fabric and the support surface; and (c) a plurality of selectively removable rigid inserts held in receptacles within the foldable pad.

25. The kit of parts of claim 24, wherein the fabric grips are attachable to the foldable pad.

26. The kit of parts of claim 24 , wherein the pad-engagement surface comprises a hook and loop fastener material and the foldable pad comprises an exposed material which is engageable with the hook and loop fastener material of the pad-engagement surface.

27. A method of treating a fabric comprising acts of:

(a) positioning a pad adjacent to a support surface, wherein positioning a pad adjacent to a support surface comprises positioning a pad which includes a terry cloth layer and a water-resistant backing material;

(b) positioning a fabric adjacent to the pad such that at least a portion of the pad is between the fabric and the support surface;

(c) gripping the fabric with a fabric grip;

(d) securing the fabric grip such that tension is applied to the fabric; and (e) treating the fabric.

28. The method of claim 27, wherein (d) comprises attaching the fabric grip to the pad.

29. The method of claim 27, wherein (d) comprises attaching the fabric grip to the pad with a hook and loop fastening material which is included on the fabric grip.

30. The method of claim 27, wherein (c) comprises gripping the fabric with a plurality of fabric grips, and (d) comprises attaching the plurality of fabric grips to the pad.

31. The method of claim 27, wherein (a) comprises positioning the pad adjacent to a vertical support surface.

32. The method of claim 27, wherein (a) comprises positioning a pad which includes a cloth layer and a layer of rigid support material.

33. The method of claim 27, wherein (e) comprises pressing the fabric.

* * * * *